US005260023A

United States Patent [19]

Evans, II

[11] Patent Number: 5,260,023

[45] Date of Patent: * Nov. 9, 1993

[54] SYSTEM AND METHOD FOR PRESERVING ACID-CONTAINING ARTICLES

[75] Inventor: Creed M. Evans, II, Great Falls, Mont.

[73] Assignee: Everseal Preservation Labs, Inc., Bozeman, Mont.

[ * ] Notice: The portion of the term of this patent subsequent to May 5, 2009 has been disclaimed.

[21] Appl. No.: 918,700

[22] Filed: Jul. 27, 1992

Related U.S. Application Data

[63] Continuation-in-part of Ser. No. 696,852, May 7, 1991, Pat. No. 5,219,524.

[51] Int. Cl.[5] ..... P21H 25/18

[52] U.S. Cl. ..... 422/40; 34/1 R; 34/4; 162/82

[58] Field of Search ..... 422/40; 162/82; 34/1 R, 34/4

[56] References Cited

U.S. PATENT DOCUMENTS

| | | |
|---|---|---|
| 3,703,353 | 11/1972 | Kuster, Jr. et al. . |
| 3,928,264 | 12/1975 | Young, Jr. et al. . |
| 4,051,276 | 9/1977 | Williams et al. . |
| 4,522,843 | 6/1985 | Kundrot . |
| 4,619,735 | 10/1986 | Norton . |
| 4,808,423 | 2/1989 | Hanson . |
| 4,863,566 | 9/1989 | Warren et al. . |
| 4,927,497 | 5/1990 | Sharpe . |
| 5,120,500 | 6/1992 | Eggersdorfer et al. . |

OTHER PUBLICATIONS

Polyester Film Encapsulation (undated).

GPO Publication 0-299-578 (1980).

Abbey Newsletter, Letter to the editor, Apr. 1986, p. 11.

Plastic Blowmolding Handbook, (1990).

Modern Plastics Encyclopedia (1990).

Abbey Newsletters, Feb. 1990, vol. 14, No. 1, p. 15.

Oxygen Indicator Ageless-Eye® (undated).

Experiments with the 'Archivist's Pen'; Jun. 1990 Abbey Newsletter, vol. 14 #3, p. 45.

Eastman Polyester Plastics for Packaging (undated).

Oxygen Indicator Ageless-Eye®, "A New Age In Foor Preservation" (undated).

Preservation of Historical Records, National Academy Press, Washington, DC, 1986.

Conservation Materials, Ltd., p. 71 (undated).

Handbook of Package Engineering, pp. 4-10 to 4-19 (undated).

Handbook of Package Engineering, pp. 4-8 to 4-9 (undated).

Handbook of Package Engineering, pp. 4-4 to 4-5 (undated).

Mary Lynn Ritzenthaler, "Archives & Manuscripts: Conservation A Manual on Physical Care and Management", Chicago, 1983.

*Primary Examiner*—Timothy M. McMahon

*Attorney, Agent, or Firm*—Rothwell, Figg, Ernst & Kurz

[57] ABSTRACT

An article preservation system and method includes an acid-containing article which is contacted with an alkaline substrate material and an artificial atmosphere which is substantially free of gaseous oxygen. The article, alkaline substrate material and artificial atmosphere are hermetically sealed, along with an oxygen-absorbing material, within an interior of a container.

24 Claims, 1 Drawing Sheet

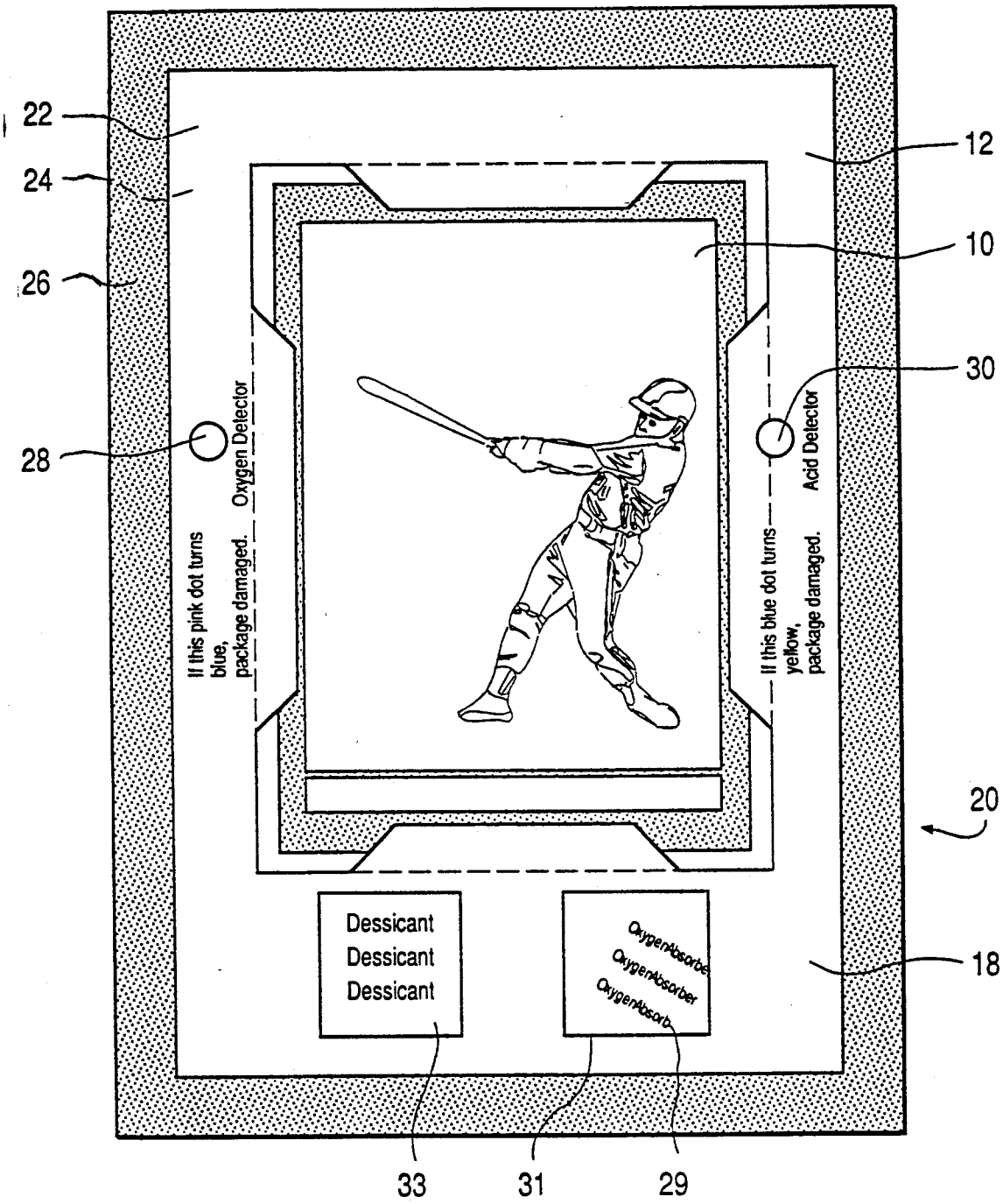
22
24
26
28
12
10
30
20
18
33
31
29
Oxygen Detector
If this pink dot turns blue, package damaged.
Acid Detector
If this blue dot turns yellow, package damaged.
Dessicant
Dessicant
Dessicant
OxygenAbsorber
OxygenAbsorber
OxygenAbsorb

SYSTEM AND METHOD FOR PRESERVING ACID-CONTAINING ARTICLES

CROSS-REFERENCE TO RELATED APPLICATION

This application is a continuation-in-part application of Ser. No. 07/696,852, filed May 7, 1991 now U.S. Pat. No. 5,219,524.

BACKGROUND OF THE INVENTION

1. Field of the Invention

The present invention relates to the preservation of acid-containing articles.

2. Description of the Background Art

Many acid-containing articles are vulnerable to destruction as a direct result of the acid contained therein. For example, most paper manufactured since the early nineteenth century contains acid. Such acid-containing paper deteriorates quite rapidly by yellowing, becoming increasingly brittle and finally disintegrating into dust, often within a matter of decades. In contrast, paper made without acid can last for centuries.

As aging, acid-containing paper increases in brittleness, it become more susceptible to damage during handling. Many documents of great value and importance, such as manuscripts, deeds, letters and the like, are printed on acid-containing paper. Destruction of such documents due to their acid content, represents a significant loss. In view thereof, numerous proposals have been made to prevent the age-related destruction of acid-containing paper documents, see, e.g., U.S. Pat. Nos. 3,703,353; 4,051,276; 4,522,843; 4,619,735; 4,808,433; 4,863,566; and 4,927,497.

One method utilized by the Library of Congress to conserve acid-containing paper documents is polyester film encapsulation. See, publication 1980 0-299-578, U.S. Government Printing Office. This method involves overlaying both sides of a document with polyester film sheets, and forming an envelope by sealing the polyester sheets around their edges ultrasonically or with tape. This U.S. Government publication indicates that documents that have been chemically deacidified and alkalized prior to polyester film encapsulation, can be preserved better than documents encapsulated without deacidification.

The most common methods used for deacidification of paper involve gaseous or liquid chemicals. However, chemical treatment of paper may be problematic for several reasons. The long term effects of any particular chemical treatment of paper are uncertain. With important paper documents disintegrating at an alarming rate, it may not be prudent to experimentally determine if a particular chemical will work to preserve the paper, or if it will destroy the document even further. The treatment of paper with chemicals generally is an irreversible process. The application of chemicals to paper is expensive and time consuming. Many of the chemicals are dangerous to use and environmentally hazardous. Additionally, documents which have been chemically deacidified are still vulnerable to air pollution and oxidative degradation by air.

While polyester film encapsulation of documents which have *not* been deacidified renders them resistant to destruction brought about by handling, the above-cited U.S. Printing Office publication 1980 0-299-578 indicates that encapsulated documents which have not been deacidified deteriorate at a faster rate than papers which have not been encapsulated. This is apparently due to the build up of degradative gases within the polyester envelope. Proposed solutions to this problem include providing air holes in the corners of the polyester envelope or leaving the envelope open along two edges thereof, to permit escape of degradative gases. However, providing holes in the envelope has been shown not to slow down the faster rate of degradation of encapsulated acid-containing paper. While deterioration of encapsulated acid-containing paper is slower inside a polyester envelope which is open along two edges, it has still been found to be faster than that observed for unencapsulated controls, as reported by Shahani, C. J., Research Officer, Library of Congress, in a letter to the editor, *Abbey Newsletter*, April 1986, p. 11.

Another proposal has been to encapsulate a sheet of alkaline paper along with the acid-containing paper to be preserved. While this has been reported as slowing the deterioration of acid-containing paper, the degradative reaction still continues with the acid-containing paper degenerating faster than non-acidic paper.

Other acid-containing articles subject to degradation brought about by their acid contents include articles of leather, certain textiles, photographs and the like.

There thus remains an urgent need in the art for improved systems and methods for preserving acid-containing articles.

SUMMARY OF THE INVENTION

In accordance with the present invention, an article preservation system comprises an acid-containing article which is in contact with an alkaline substrate material and a gaseous atmosphere which is substantially free of gaseous oxygen. The article, alkaline substrate material, gaseous atmosphere and an oxygen-absorbing material are hermetically sealed within an interior of a container.

BRIEF DESCRIPTION OF THE DRAWING

The single FIGURE is an elevational view, partly schematic, of an article preservation system in accordance with one embodiment of the present invention.

DETAILED DESCRIPTION OF THE PREFERRED EMBODIMENTS

With reference to the drawing, one embodiment of an article preservation system according to the present invention includes an acid-containing paper document 10, which can be any suitable article for preservation, such as a baseball card as illustrated, or a manuscript, deed, letter, comic book, stamp, photograph, film or the like. While the invention is further described in detail with respect to paper articles, it is to be understood that the invention can be equally applicable to other acid-containing articles such as leather, textiles, film and the like.

Referring back to the drawing, an alkaline substrate material 12 is in contact with document 10. In the embodiment shown, the alkaline substrate material is a paper matte formed of archival alkaline paper that will not react with the acidic document. The alkaline matte can comprise about 30% by weight calcium carbonate and about 70% by weight cellulose and alkalies.

For double sided documents which require viewing on both sides, the alkaline paper matte is sized to contact only the edges of document 10 while permitting visibility of the document from both sides. Acid within document 10 migrates into the alkaline paper substrate matte 12 in contact therewith.

Document 10 and alkaline substrate material 12 in contact therewith are hermetically sealed within the interior 18 of a pouch, package or container 20.

In accordance with the present invention, document degradation brought about by the presence of gaseous oxygen is avoided by sealing an artificial gaseous atmosphere within container 20. The artificial atmosphere is substantially free of gaseous oxygen and in contact with document 10. In preferred embodiments, the artificial atmosphere includes at least one inert gas. In particularly preferred embodiments, the artificial atmosphere includes argon and helium, most preferably about 70% argon and about 30% helium.

As noted above, the artificial atmosphere within container 20 is substantially free of gaseous oxygen, i.e., contains less than about 40 ppm $O_2$, more preferably, less than about 30 ppm $O_2$, and most preferably less than about 15 ppm $O_2$.

In particularly preferred embodiments, the artificial atmosphere within container 20 is at a pressure slightly greater than earth's atmospheric pressure at sea level, for example, about one percent greater.

In accordance with one embodiment, an $O_2$ indicator 28 is sealed within the interior of container 20. The $O_2$ indicator 28 is capable of indicating the presence of gaseous oxygen in the interior of container 20. An $O_2$ indicator can be selected which is colorimetric and changes color if the oxygen content of the artificial atmosphere within container 20 is raised to about 0.5% gaseous oxygen. One suitable oxygen indicator is manufactured by Mitsubishi Gas Chemical Company and sold under the trademark AGELESS-EYE®, which changes from pink to blue if the gaseous oxygen concentration increases to about 0.5% or higher.

In the embodiment shown, container 20 is formed from respective top and bottom sheets 22 and 24 of substantially transparent polymer material such as copolyester, e.g., PET. Sheets 22 and 24 can be any suitable thickness, e.g., about 20 mils in thickness.

Respective top and bottom sheets 22 and 24 are sealed together about their edges by any suitable means. In preferred embodiments, sheets 22 and 24 have peripheral seals 26 formed by Radio Frequency Sealing. Seals 26 advantageously have a width of from about ⅛th inch to about ½ inch and do not contact the substrate material 12 or document 10.

A major concern with encapsulating an acidic document in a polyester enclosure with a modified atmosphere is the longevity of the package. The longevity of the package can be defined as the length of time required to raise the ambient oxygen levels enough to cause the oxygen indicator 28 to change color. In preferred embodiments, $O_2$ indicator 28 is calibrated to colorimetricly change whenever the $O_2$ level allows hydrolysis to occur. $O_2$ contamination in packages may come from one of three possible sources: 1) the headspace inside the package; 2) residual oxygen in the document 10 and matte 12; and 3) $O_2$ permeating through sheets 22 and 24. $O_2$ inside the headspace is substantially eliminated by sealing the document in the artificial atmosphere, but the problems of residual oxygen in the document and oxygen seepage can be a problem.

An archival package must last for a number of years to make it feasible as a document storage device. In accordance with the present invention, the lifetime of the package is extended by sealing an oxygen-absorbing material 29 inside the package. One example of an oxygen absorber, also called an oxygen "scavenger", is ferrous iron that has been reduced and ground to a fine powder. The iron oxidizes in the presence of atmospheric oxygen, thereby removing oxygen from the artificial atmosphere. To facilitate the iron oxidation process, silica (silicone dioxide), containing water, can be added to the ferrous oxide. The silicon dioxide also acts as a humidity control to absorb any $H_2O$ that permeates through sheets 22 and 24.

Another example of an oxygen absorber is ascorbic acid.

In preferred embodiments, the oxygen scavenger is contained in a small envelope 31 of porous plastic film or paper. This packet can hold the oxygen absorber and not allow contamination of the document pouch. Oxygen dissolved in the document, as well as oxygen permeating through layers 22 and 24, is absorbed by the oxygen scavenger. A good example of an oxygen scavenger is AGELESS® oxygen absorber, manufactured by Mitsubishi Gas Chemical America.

In accordance with one aspect of the invention, the document 10 and substrate 12 are sealed within container 20 in a zero humidity environment so that the interior of container 20 is substantially moisture free. This further reduces degradation of document 10.

Some documents require exact levels of relative humidity (RH). For example, photographs and motion pictures are preferably preserved with a humidity level between 30% and 40%, whereas certain paper documents require an RH of about 47%. In accordance with one embodiment, to maintain a desired humidity level, a desiccant 33 is sealed inside the pouch. One example of a desiccant is silica gel. Silica gel is a substantially pure, chemically inert amorphous silica. Silica gel provides moisture buffering by absorbing water, especially in the form of RH. In preferred embodiments, silica gel is selected to colorimetricly change from bright blue to pink when saturated with moisture. One suitable silica gel material is manufactured by Fuji-Davison Chemical, Inc. under the trademark of Art Sort®, and is available in blue indicating grade and regular white grade. By varying the amount of blue indicating silica gel and white silica gel, different colorimetric indicators can be provided to indicate various levels of RH inside the pouch.

As indicated above, another factor relating to the lifetime of the package is permeability of sheets 22 and 24 to oxygen. In preferred embodiments, sheets 22 and 24 are substantially impervious to gaseous oxygen, and can be single layer sheets or multilayer sheets. An example of a suitable clear multilayer barrier film is PET coextruded with polyvinylidene chloride copolymer (PVDC).

Another example of an oxygen barrier film is metalized polyester, which is a polyester film metalized with a thin layer of aluminum.

Another means for providing an oxygen barrier is a barrier coating. Barrier coatings can either be coextruded with the sheet material or applied to the outside of the pouch. Some examples of barrier coatings are ethylene vinyl alcohol copolymer (EVOH), Silicon Dioxide ($SiO_2$) and nitrile polymers (e.g., Barex®). In a particularly preferred embodiment, a PVDC such as Saran®, is applied to the outside of a package formed of PET sheets 22 and 24, after sealing.

In order to alert a viewer that the alkaline substrate material has reached the end of its useful life when sufficient acid has migrated from document 10 into substrate 12 so as to render the substrate acidic, a pH indicator 30 is sealed within the interior of container 20 in preferred embodiments. In particularly preferred embodiments, the pH indictor is colorimetric. The pH indicator can, for example, change color when the pH of the substrate is lowered to about pH 5.7 or less by migration of acid from document 10. One suitable colorimetric pH indicator is chlorophenol red.

In preferred embodiments, matte 12 holds the oxygen scavenger, the desiccant, the $O_2$ indicator and the pH indicator. In the embodiment shown, matte 12 provides a rigid frame for the document 10, so as to hold the document securely.

Ultra violet (UV) radiation can also damage documents. Accordingly, one embodiment of the invention utilizes a UV inhibitor or UV blocker which is incorporated into polymeric sheets 22 and 24, or applied as a coating thereto. One suitable film material is sold by Kodak under the trademark ULTROS® PETG 6763.

In the method of the present invention, an acid-containing article is contacted with an alkaline substrate material and an artificial gaseous atmosphere which is substantially free of oxygen. The article, alkaline substrate material, artificial atmosphere and an oxygen-absorbing material are sealed within the interior of a container formed, for example, from PET sheets, as noted above.

The use of barrier plastics or coatings, desiccants, oxygen scavengers and colorimetric indicators provide a "smart package" which is a dynamic preservation system instead of a passive one. With these controls over the microclimate inside the package, items that are chemically sensitive can be preserved for long periods.

The present invention provides a safe and effective way to protect acid-containing articles, without subjecting the articles to liquid or gaseous chemical alteration. The colorimetric pH and $O_2$ indicators of the present invention provide easy means for alerting the user of changes in the sealed interior of the system which could deleteriously impact the longevity of the document. The invention is also a reversible process leaving a document in almost its original condition after removal from the container.

The present invention also provides a means for permitting libraries and document repositories to display important articles and documents to the public rather than hiding such articles and documents in environmentally controlled vaults.

The invention further permits private citizens to have their precious articles and documents protected, since the articles and documents can be sealed in accordance with the present invention and returned to the owner.

When polymer sheets of sufficient thickness (e.g., 20 mil) are utilized in accordance with the present invention, articles and documents are prevented from folding and creasing which further protects them from wear and tear. Hermetic sealing within the polymer enclosure also protects the articles and documents from water damage, smoke damage, insects, vermin, air pollution, bacterial agents and fungi.

Since many modifications, variations and changes in detail may be made to the described embodiments, it is intended that all matter in the foregoing description and shown in the accompanying drawing be interpreted as illustrative and not in a limiting sense.

What is claimed is:

1. An article preservation system, comprising an oxygen-absorbing material and an acid-containing article, which article is in contact with an alkaline substrate material and a gaseous atmosphere which is substantially free of gaseous oxygen; the article, alkaline substrate material, oxygen-absorbing material and gaseous atmosphere being hermetically sealed within an interior of a container.

2. The system of claim 1 wherein at least a portion of said container is at least partially transparent so as to permit viewing of the article from outside the container.

3. The system of claim 1 further including a desiccant sealed within the interior of said container.

4. The system of claim 3 wherein at least a portion of said container is at least partially transparent so as to permit viewing of the article from outside the container.

5. The system of claim 4 wherein said article is a paper document.

6. The system of claim 5 wherein the container is formed of substantially transparent polymer sheet material which is substantially impervious to gaseous oxygen.

7. The system of claim 6 wherein the polymer sheet material comprises an inner copolyester layer and an outer layer of PVDC sheet material.

8. The system of claim 6 wherein said sheet comprises polymeric sheet material on which is applied an oxygen barrier coating.

9. The system of claim 6 wherein the polymer sheet material includes a UV blocker.

10. The system of claim 5 wherein said substrate is alkaline paper comprising calcium carbonate and cellulose.

11. The system of claim 10 wherein said substrate comprises about 30% calcium carbonate, and about 70% cellulose and alkalies.

12. The system of claim 5 wherein said gaseous atmosphere includes inert gas selected from the group consisting of argon, helium and mixtures thereof.

13. The system of claim 12 wherein the artificial atmosphere comprises about 70% argon and about 30% helium.

14. The system of claim 1 further including an $O_2$ indicator sealed within the interior of said container, capable of indicating the presence of gaseous oxygen within said interior.

15. The system of claim 14 wherein said $O_2$ indicator is capable of indicating an $O_2$ content in the atmosphere of the interior of said container of about 0.5% $O_2$ or higher.

16. The system of claim 3 further including a pH indicator within the interior of said container capable of indicating when said substrate material becomes acidic.

17. A method of preserving an acid-containing article, comprising contacting the article with an alkaline substrate material and a gaseous atmosphere which is substantially free of gaseous oxygen, providing an oxygen-absorbing material, and sealing the article, alkaline substrate material, oxygen-absorbing material and gaseous atmosphere within an interior of a container.

18. The method of claim 17 wherein at least a portion of said container is transparent so as so permit viewing of the article from outside the container.

19. The method of claim 17 further comprising the step of providing a desiccant, wherein said desiccant is sealed within the interior of said container.

20. The method of claim 19 wherein at least a portion of said container is transparent so as so permit viewing of the article from outside the container.

21. The method of claim 20 wherein the article contacted with said substrate and sealed in said container comprises a paper document.

22. The method of claim 18 wherein said container is substantially impervious to gaseous oxygen.

23. The method of claim 22 wherein the sealing step includes sealing an $O_2$ indicator within said container.

24. The method of claim 19 wherein the sealing step includes sealing a pH indicator within said container.

* * * * *